US009900711B2

(12) United States Patent
Sänger et al.

(10) Patent No.: US 9,900,711 B2
(45) Date of Patent: Feb. 20, 2018

(54) ACOUSTICAL CROSSTALK COMPENSATION

(71) Applicant: Sonion Nederland B.V., Hoofddorp (NL)

(72) Inventors: Anne-Marie Sänger, Koog a/d Zaan (NL); Andreas Tiefenau, Koog a/d Zaan (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 14/729,683

(22) Filed: Jun. 3, 2015

(65) Prior Publication Data

US 2015/0358746 A1 Dec. 10, 2015

(30) Foreign Application Priority Data

Jun. 4, 2014 (EP) ..... 14171061

(51) Int. Cl.
*H04R 25/00* (2006.01)
*H04R 3/02* (2006.01)
(Continued)

(52) U.S. Cl.
CPC ..... *H04R 25/453* (2013.01); *H04R 1/326* (2013.01); *H04R 1/40* (2013.01); *H04R 3/02* (2013.01);
(Continued)

(58) Field of Classification Search
CPC ..... H04R 25/453; H04R 1/326; H04R 1/40; H04R 3/02; H04R 25/405; H04R 2410/01; H04R 2460/01
(Continued)

(56) References Cited

U.S. PATENT DOCUMENTS 6,683,959 B1 * 1/2004 Kuwano ..... H03H 17/04 381/1
6,788,796 B1 9/2004 Miles et al.
(Continued)

FOREIGN PATENT DOCUMENTS

EP 2723102 A2 4/2014
EP 2925016 A2 9/2015
WO 2012/139230 A1 10/2012

OTHER PUBLICATIONS

Extended European Search Report corresponding to co-pending European Patent Application Serial No. 14171061.6, European Patent Office, dated Sep. 18, 2014; (3 pages).

*Primary Examiner* — Sean H Nguyen
(74) *Attorney, Agent, or Firm* — Nixon Peabody LLP

(57) ABSTRACT

A method for compensating for acoustic crosstalk between a first and a second microphone unit being acoustically connected to a shared volume. The method includes the steps of providing a first output signal, $P_{out}$, from the first microphone unit, providing a second output signal, $U_{out}$, from the second microphone unit, and generating a compensated output signal by combining a portion of one of the output signals with the other output signal via addition or subtraction in order to compensate for acoustical crosstalk. The invention further relates to a microphone module configured to implement the before-mentioned method. The invention further relates to a hearing aid comprising the microphone module.

13 Claims, 4 Drawing Sheets

(51) Int. Cl.
*H04R 1/32* (2006.01)
*H04R 1/40* (2006.01)

(52) U.S. Cl.
CPC ..... *H04R 25/405* (2013.01); *H04R 2410/01* (2013.01); *H04R 2460/01* (2013.01)

(58) Field of Classification Search
USPC ..... 381/317
See application file for complete search history.

(56) References Cited

U.S. PATENT DOCUMENTS 6,831,577 B1 12/2004 Furst
6,853,290 B2 2/2005 Jorgensen et al.
6,859,542 B2 2/2005 Johannsen et al.
6,888,408 B2 5/2005 Furst et al.
6,914,992 B1 7/2005 van Halteren et al.
6,919,519 B2 7/2005 Ravnkilde et al.
6,930,259 B1 8/2005 Jorgensen et al.
6,943,308 B2 9/2005 Ravnkilde et al.
6,974,921 B2 12/2005 Jorgensen et al.
7,008,271 B2 3/2006 Jorgensen
7,012,200 B2 3/2006 Moller
7,062,058 B2 6/2006 Steeman et al.
7,062,063 B2 6/2006 Hansen et al.
7,072,482 B2 7/2006 Van Doom et al.
7,088,839 B2 8/2006 Geschiere et al.
7,110,560 B2 9/2006 Stenberg
7,136,496 B2 11/2006 van Halteren et al.
7,142,682 B2 11/2006 Mullenborn et al.
7,181,035 B2 2/2007 van Halteren et al.
7,190,803 B2 3/2007 van Halteren
7,206,428 B2 4/2007 Geschiere et al.
7,221,767 B2 5/2007 Mullenborn et al.
7,221,769 B1 5/2007 Jorgensen
7,227,968 B2 6/2007 Van Heltren et al.
7,239,714 B2 7/2007 de Blok et al.
7,245,734 B2 7/2007 Niederdraenk
7,254,248 B2 8/2007 Johannsen et al.
7,286,680 B2 10/2007 Steeman et al.
7,292,700 B1 11/2007 Engbert et al.
7,292,876 B2 11/2007 Bosh et al.
7,336,794 B2 2/2008 Furst et al.
7,376,240 B2 5/2008 Hansen et al.
7,403,630 B2 7/2008 Jorgensen et al.
7,415,121 B2 8/2008 Mögelin et al.
7,425,196 B2 9/2008 Jorgensen et al.
7,460,681 B2 12/2008 Geschiere et al.
7,466,835 B2 12/2008 Stenberg et al.
7,492,919 B2 2/2009 Engbert et al.
7,548,626 B2 6/2009 Stenberg et al.
7,657,048 B2 2/2010 van Halteren et al.
7,684,575 B2 3/2010 van Halteren et al.
7,706,561 B2 4/2010 Wilmink et al.
7,715,583 B2 5/2010 Van Halteren et al.
7,728,237 B2 6/2010 Pedersen et al.
7,809,151 B2 10/2010 Van Halteren et al.
7,822,218 B2 10/2010 Van Halteren
7,899,203 B2 3/2011 Van Halteren et al.
7,912,240 B2 3/2011 Madaffari et al.
7,946,890 B1 5/2011 Bondo et al.
7,953,241 B2 5/2011 Jorgensen et al.
7,961,899 B2 6/2011 Van Halteren et al.
7,970,161 B2 6/2011 van Halteren
8,098,854 B2 1/2012 van Halteren et al.
8,101,876 B2 1/2012 Andreasen et al.
8,103,039 B2 1/2012 van Halteren et al.
8,160,290 B2 4/2012 Jorgensen et al.
8,170,249 B2 5/2012 Halteren
8,189,804 B2 5/2012 Hruza
8,189,820 B2 5/2012 Wang
8,223,996 B2 7/2012 Beekman et al.
8,233,652 B2 7/2012 Jorgensen et al.
8,259,963 B2 9/2012 Stenberg et al.
8,259,976 B2 9/2012 van Halteren
8,259,977 B2 9/2012 Jorgensen et al.
8,280,082 B2 10/2012 van Halteren et al.
8,284,966 B2 10/2012 Wilk et al.
8,313,336 B2 11/2012 Bondo et al.
8,315,422 B2 11/2012 van Halteren et al.
8,331,595 B2 12/2012 van Halteren
8,369,552 B2 2/2013 Engbert et al.
8,379,899 B2 2/2013 van Halteren et al.
8,509,468 B2 8/2013 van Halteren et al.
8,526,651 B2 9/2013 Lafort et al.
8,526,652 B2 9/2013 Ambrose et al.
2005/0008170 A1* 1/2005 Pfaffinger ..... H04S 7/30 381/96
2009/0003640 A1 1/2009 Burnett
2009/0304198 A1* 12/2009 Herre ..... G10L 19/008 381/66
2011/0182453 A1 7/2011 van Hal et al.
2011/0189880 A1 8/2011 Bondo et al.
2011/0299708 A1 12/2011 Bondo et al.
2011/0299712 A1 12/2011 Bondo et al.
2011/0311069 A1 12/2011 Ambrose et al.
2012/0014548 A1 1/2012 van Halteren
2012/0027245 A1 2/2012 van Halteren et al.
2012/0140966 A1 6/2012 Mocking et al.
2012/0155683 A1 6/2012 van Halteren
2012/0155694 A1 6/2012 Reeuwijk et al.
2012/0255805 A1 10/2012 van Halteren et al.
2012/0328142 A1* 12/2012 Horibe ..... H04R 3/005 381/355
2013/0028451 A1* 1/2013 de Roo ..... H04R 1/38 381/312
2013/0136284 A1 5/2013 van Hal et al.
2013/0142370 A1 6/2013 Engbert et al.
2013/0163799 A1 6/2013 Van Halteren
2013/0195295 A1 8/2013 van Halteren et al.
2014/0270184 A1* 9/2014 Beaton ..... H04S 7/307 381/17
2015/0350805 A1* 12/2015 Christoph ..... H04S 7/303 381/303

* cited by examiner

ACOUSTICAL CROSSTALK COMPENSATION

CROSS-REFERENCE TO RELATED APPLICATION

This application claims the benefit of European Patent Application Serial No. 14171061.6, filed Jun. 4, 2014, and titled "Acoustical Crosstalk Compensation," which is incorporated herein by reference in its entirety.

FIELD OF THE INVENTION

The present invention relates to compensation of acoustical crosstalk between two microphones units being acoustically connected to a shared volume. In particular, the present invention relates to a method and a microphone module for hearing aid applications, said method and microphone module being arranged to compensate for acoustical crosstalk between two microphone units.

BACKGROUND OF THE INVENTION

Various combinations of Omni directional microphones and directional microphones have been suggested over the years.

As an example WO 2012/139230 discloses various combinations of Omni directional microphones and directional microphones.

In the embodiments depicted in FIG. 13 of WO 2012/139230 an Omni directional microphone "p" is combined with a directional microphone "u". The two microphones are both acoustically connected to the combined front volume (11, 12). Moreover, the two microphones share the same sound inlet (3). A rear sound inlet (2) is acoustically connected to the rear volume of the directional microphone.

It is a disadvantage of the embodiment shown in FIG. 13 of WO 2012/139230 that acoustical crosstalk will occur between the front volumes (11) and (12). The acoustical crosstalk between the front volumes will introduce a certain amount of unwanted directionality of the Omni directional microphone.

It may be seen as an object of embodiments of the present invention to provide an arrangement and an associated method where the influence of acoustical crosstalk is controlled.

It may be seen as a further object of embodiments of the present invention to provide an arrangement and an associated method where the influence of acoustical crosstalk is significantly reduced.

SUMMARY OF INVENTION

The above-mentioned objects are complied with by providing, in a first aspect, a method for compensating for acoustic crosstalk between a first and a second microphone unit being acoustically connected to a shared volume, the method comprising the steps of

- proving or providing a first output signal, $P_{out}$, from the first microphone unit,
- proving or providing a second output signal, $U_{out}$, from the second microphone unit, and
- generating a compensated output signal by combining a portion of one of the output signals with the other output signal via addition or subtraction in order to compensate for acoustical crosstalk.

The first and second microphone units may form part of a microphone module suitable for being incorporated into for example a hearing aid. The hearing aid may further include suitable electronics and speaker units. The hearing aid may belong to one of the standard types of hearing aids, i.e. In the Canal (ITC), Behind the Ear (BTE) or Completely in the Canal (CIC).

The term acoustically connected should be understood broadly. Thus, in the present context acoustically connected may involve that the first and second microphone units share the same volume, such as a shared front or rear volume. Alternatively, the first and second microphone units may be connected to a shared front or rear volume by other suitable means, such as via acoustical channels.

The process step of combining a portion of one of the output signals with the other output signal via addition or subtraction in order to compensate for acoustical crosstalk may be performed electronically, such as in the analogue or in the digital domain. Suitable signal processing means, such as microprocessors, may be provided for this specific task.

It is an advantage of the present invention that acoustical crosstalk between closely arranged microphone units in a compact microphone module may be controlled. In fact the present invention allows that compact microphone modules with simple mechanical designs may generate a high quality output signal in terms of directionality.

In a first embodiment of the first aspect the first and second output signals may be combined by subtracting a portion of the second output signal, $U_{out}$, from the first output signal, $P_{out}$, in order to compensate for acoustical crosstalk. The second output signal, $U_{out}$, may be subtracted from the first output signal, $P_{out}$, in accordance with the following expression:

$$P_{out}-X\cdot U_{out}$$

where X may be a frequency dependent or a constant coefficient within the range $0 \leq X < 1$. The term frequency dependent is here to be understood as if X varies as a function of the audio frequency, i.e. X(f).

In a second embodiment of the first aspect the first and second output signals may be combined by adding a portion of the first output signal, $P_{out}$, to the second output signal, $U_{out}$, in order to compensate for acoustical crosstalk. The first output signal, $P_{out}$, may be added to the second output signal, $U_{out}$, in accordance with the following expression:

$$U_{out}+X\cdot P_{out}$$

where X may be a frequency dependent or a constant coefficient within the range $0 \leq X < 1$.

The shared volume may comprise a shared front volume, or it may comprise a shared rear volume.

In case of a shared front volume the first microphone unit may comprise an Omni-directional microphone, whereas the second microphone unit may comprise a directional microphone. The Omni-directional microphone and the directional microphone may be acoustically connected to a common sound inlet port via the shared front volume. The first and second microphone units may share the same volume.

In a second aspect the present invention relates to a computer program product for performing the method of the first aspect when said computer program product is run on a computer or a microcontroller.

In a third aspect the present invention relates to a microphone module comprising

- a first microphone unit providing a first output signal, $P_{out}$, a second microphone unit providing a second output signal, $U_{out}$, and a signal processor being adapted to generate a compensated output signal by combining a portion of one of the output signals with the other output signal via addition or subtraction in order to compensate for acoustical crosstalk.

The microphone module according to the third aspect of the present invention may be configured so that it forms a self-contained device that may be incorporated directly into for example a hearing aid. The hearing aid assembly may belong to one of the standard types of hearing aids, i.e. In the Canal (ITC), Behind the Ear (BTE) or Completely in the Canal (CIC).

The microphone units may in principle be any type of microphone, such as MEMS microphones, moving armature type microphones, moving magnet type microphones, moving coil type microphones etc.

In a first embodiment of the third aspect the first and second output signals may be combined by subtracting a portion of the second output signal, $U_{out}$, from the first output signal, $P_{out}$, in order to compensate for acoustical crosstalk. The second output signal, $U_{out}$, may be subtracted from the first output signal, $P_{out}$, in accordance with the following expression:

$$P_{out}-X\cdot U_{out}$$

where X may be a frequency dependent or a constant coefficient within the range $0 \leq X < 1$.

In a second embodiment of the third aspect the first and second output signals may be combined by adding a portion of the first output signal, $P_{out}$, to the second output signal, $U_{out}$, in order to compensate for acoustical crosstalk. The first output signal, $P_{out}$, may be added to the second output signal, $U_{out}$, in accordance with the following expression:

$$U_{out}+X\cdot P_{out}$$

where X may be a frequency dependent or a constant coefficient within the range $0 \leq X < 1$.

The shared volume may comprise a shared front volume, or it may comprise a shared rear volume.

In case of a shared front volume the first microphone unit may comprise an Omni-directional microphone, whereas the second microphone unit may comprise a directional microphone. The Omni-directional microphone and the directional microphone may be acoustically connected to a common sound inlet port via the shared front volume.

In a fourth aspect, the present invention relates to a hearing aid assembly comprising a microphone module according to the third aspect. The hearing aid assembly may comprise further components like additional processor means and suitable speaker units. The hearing aid assembly may belong to one of the standard types of hearing aids, i.e. In the Canal (ITC), Behind the Ear (BTE) or Completely in the Canal (CIC).

BRIEF DESCRIPTION OF THE DRAWINGS

The present invention will now be described in further details with reference to the accompanying figures where.

Figure 1:
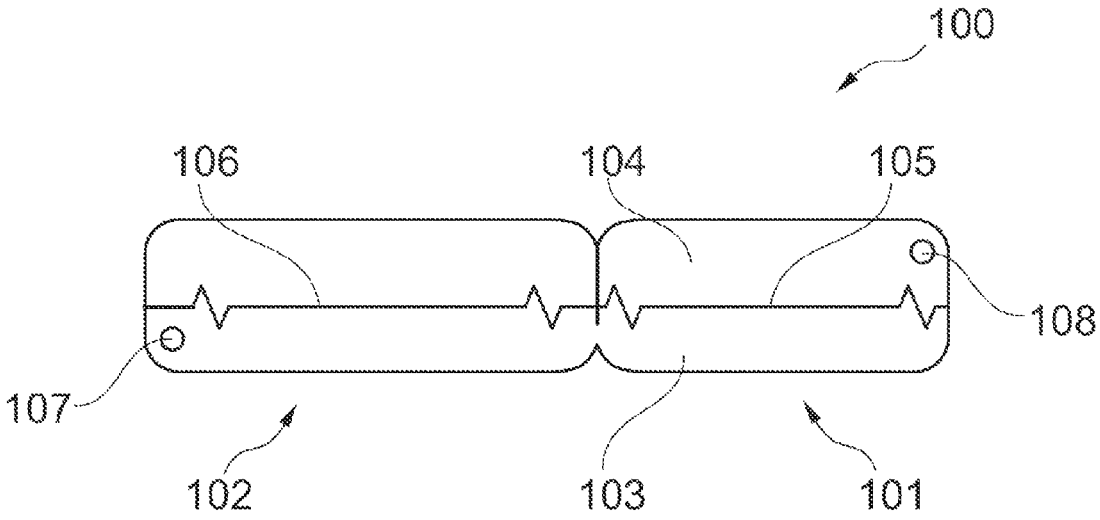
FIG. 1 shows a microphone module including an Omni directional microphone and a directional microphone.

While the invention is susceptible to various modifications and alternative forms, specific embodiments have been shown by way of examples in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF PREFERRED EMBODIMENTS

In its most general aspect the present invention relates to a microphone module including at least two microphone units, such as at least one Omni directional microphone and at least one directional microphone being acoustically coupled to a shared volume, such as a shared front or a shared rear volume.

In the present context acoustically coupled should be understood broadly. This means that the two microphones may share the same front or rear volume or they may be acoustically coupled to a common front or rear volume via appropriate means. In order to compensate for acoustical crosstalk between the Omni directional microphone and the directional microphone a portion of the signal from the directional microphone is subtracted from the signal from the Omni directional microphone. Alternatively, a portion of the signal from the Omni directional microphone is added to the signal from the directional microphone for acoustical crosstalk compensation.

The present invention will now be described with reference to a method and microphone module having a shared front volume. The principle of the present invention is however also applicable to methods and arrangements sharing a rear volume.

Referring now to FIG. 1 a microphone module 100 having a directional microphone 101 and an Omni directional microphone 102 is depicted. The two microphones share the same front volume 103 which is acoustically connected to the front sound inlet 107. The back volume 104 of the directional microphone 101 is acoustically connected to the delay sound inlet 108. The directional microphone 101 and an Omni directional microphone 102 have respective moveable membranes 105 and 106 arranged within the microphone module 100. Arrangements for converting movements of the membranes 105 and 106 in response to incoming sound waves to electrical signals are, even though not depicted in FIG. 1, provided as well.

The microphone module 100 depicted in FIG. 1 may advantageously be applied in various types of hearing aids in order to convert incoming sound waves to electrical signals. These electrical signals are typically processed, including amplified and filtered, before being applied as a drive signal to a speaker unit.

The difference between the acoustical impedances of the front sound inlet 107 and the delay sound inlet 108 introduces an acoustical delay. This acoustical delay ensures a certain directionality of the microphone module. In a polar plot, and with the directional microphone facing the sound source, the front/rear ratio should preferably take a positive value in that such a positive value enhances speech intelligibility in hearing aids.

If no signal processing is applied to the output signals from the directional microphone and an Omni directional microphone acoustical crosstalk between the two microphones will influence the resulting signal. As a consequence the Omni directional microphone will show a certain directionality which by all means should be avoided.

Figure 2:
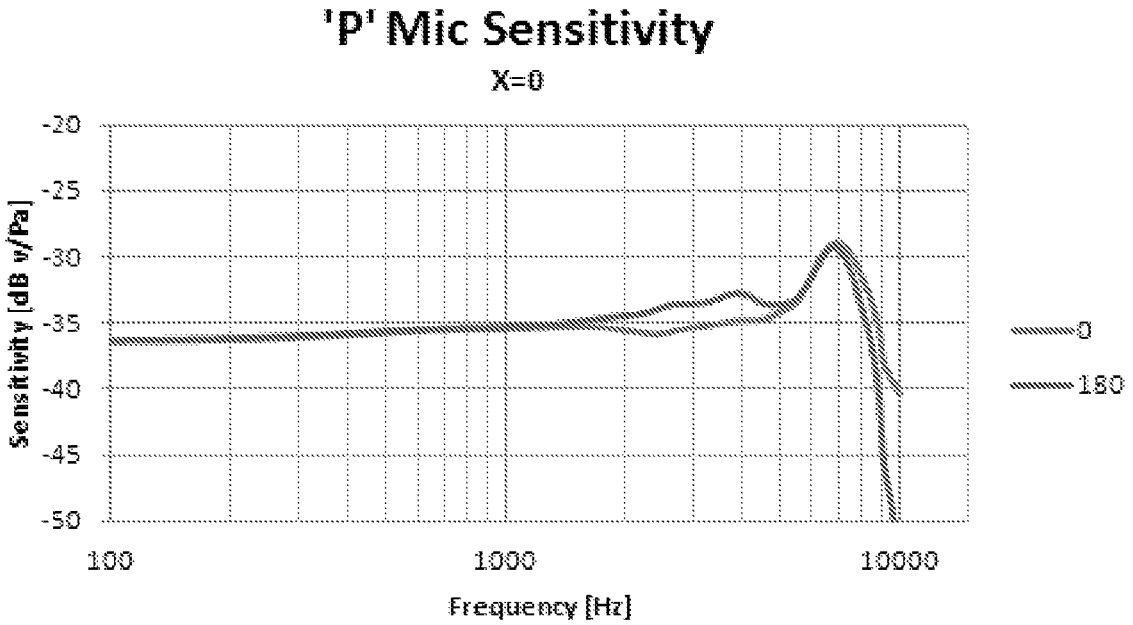
FIG. 2 shows the sensitivity of an Omni directional microphone of a microphone module without crosstalk compensation.

The unwanted directionality of the Omni directional microphone is illustrated by simulations in FIG. 2 where the sensitivity of the Omni directional microphone is depicted for two sound directions, namely zero degrees and 180 degrees. As seen the unwanted directionality of the Omni directional microphone is pronounced between 1.5 kHz and 5.5 kHz.

As addressed previously, the acoustical crosstalk between the directional microphone and the Omni directional microphone may be controlled, such as reduced, by either 1) subtracting a portion of the directional output signal, $U_{out}$, from the Omni directional output signal, $P_{out}$, or
2) adding a portion of the Omni directional output signal, $P_{out}$, to the directional output signal, $U_{out}$ In the following acoustical crosstalk compensation according to the present invention is addressed with reference to point 1) which may be expressed as $$P_{out}-X\cdot U_{out}$$

where $P_{out}$ is the output signal from the Omni directional microphone and $U_{out}$ is the output signal from the directional microphone unit. The coefficient X may be a frequency dependent or a constant coefficient within the range $0 \leq X < 1$ depending on the selected crosstalk compensation level. By frequency dependent is meant that X varies as a function of the audio frequency, i.e. X(f).

Figure 3:
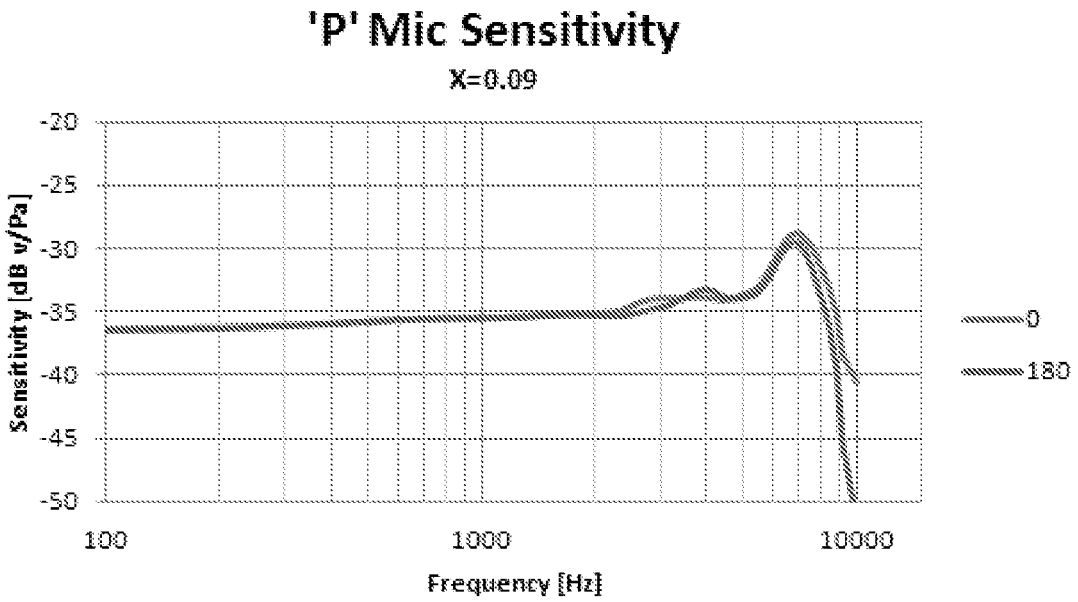
FIG. 3 shows the sensitivity of an Omni directional microphone of a microphone module with crosstalk compensation.

Referring now to FIG. 3 the crosstalk compensation method of the present invention is illustrated. In FIG. 3, $U_{out}$ is subtracted from $P_{out}$ in a situation where X equals 0.09. As seen in FIG. 3 the Omni directional microphone now shows similar sensitivity curves for sound waves arriving from zero degrees and 180 degrees. Thus, by implementing the method of the present, i.e. by subtracting a part of $U_{out}$ from $P_{out}$, the intended Omni directional properties of the Omni directional microphone can be re-established.

Figure 4:
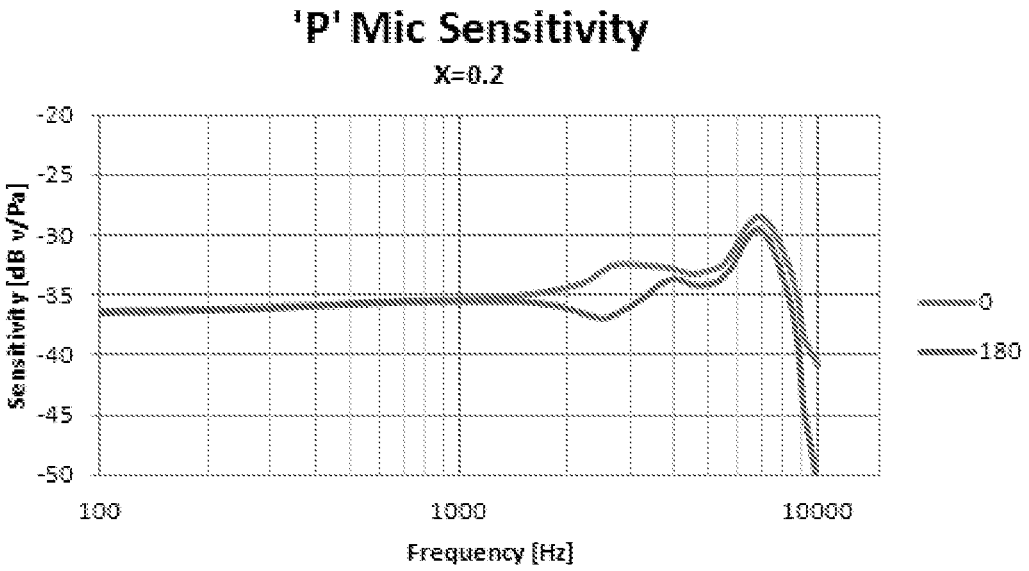
FIG. 4 shows the sensitivity of an Omni directional microphone a of microphone module with crosstalk overcompensation.

An overcompensated scenario may be reached by increasing X to around 0.2, cf. FIG. 4. In this situation a positive front/rear ratio in the polar plot may be obtained. The resulting directionality of the Omni directional microphone would imitate the natural directionality of the human ear.

The invention claimed is:

1. A method for compensating for acoustic crosstalk between a first and a second microphone unit being acoustically connected to a shared volume, the method comprising the steps of:

providing a first output signal, $P_{out}$, from the first microphone unit, providing a second output signal, $U_{out}$, from the second microphone unit, and generating a compensated output signal in accordance with $P_{out}-X\cdot U_{out}$ or $U_{out}+X\cdot P_{out}$ in order to compensate for acoustical crosstalk, wherein $0 \leq X < 1$ and wherein X is a coefficient and is frequency dependent.

2. A method according to claim 1, wherein the shared volume comprises a shared front volume.

3. A method according to claim 1, wherein the shared volume comprises a shared rear volume.

4. A method according to claim 1, wherein the first microphone unit comprises an Omni-directional microphone, and wherein the second microphone unit comprises a directional microphone.

5. A method according to claim 4, wherein the Omni-directional microphone and the directional microphone are acoustically connected to a common sound inlet port via a shared front volume.

6. A method according to claim 1, wherein the first and second microphone units share a same volume.

7. A non-transitory computer-readable medium encoded with a computer program for performing the method of claim 1 when said computer program is run on a computer or a microcontroller.

8. A method according to claim 1, wherein the portion is less than all of the one of the output signals.

9. A microphone module comprising a first microphone unit providing a first output signal, $P_{out}$, a second microphone unit providing a second output signal, $U_{out}$, and a signal processor being adapted to generate a compensated output signal in accordance with $P_{out}-X\cdot U_{out}$ or $U_{out}+X\cdot P_{out}$ in order to compensate for acoustical crosstalk, wherein $0 \leq X < 1$ and wherein X is a coefficient and is frequency dependent.

10. A microphone module according to claim 9, wherein the shared volume comprises a shared front volume or a shared rear volume.

11. A microphone module according to claim 9, wherein the first microphone unit comprises an Omni-directional microphone, and wherein the second microphone unit comprises a directional microphone.

12. A microphone module according to claim 11, wherein the Omni-directional microphone and the directional microphone are acoustically connected to a common sound inlet port via a shared front volume.

13. A hearing aid assembly comprising a microphone module according to claim 9.

* * * * *